US007017656B2

(12) United States Patent
Beddome et al.

(10) Patent No.: US 7,017,656 B2
(45) Date of Patent: Mar. 28, 2006

(54) HEAT EXCHANGER WITH MANIFOLD TUBES FOR STIFFENING AND LOAD BEARING

(75) Inventors: David W. Beddome, San Pedro, CA (US); Steven Ayres, Redondo Beach, CA (US); Edward Yuhung Yeh, Rancho Palos Verdes, CA (US); Ahmed S. Hammoud, Cypress, CA (US); David G. Bridgnell, Palos Verdes Peninsula, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/864,581

(22) Filed: May 24, 2001

(65) Prior Publication Data

US 2002/0174978 A1 Nov. 28, 2002

(51) Int. Cl.
*F28F 7/00* (2006.01)

(52) U.S. Cl. ..... 165/82; 165/81; 165/153

(58) Field of Classification Search ..... 165/81, 165/167, 153, 906, 82, 166, DIG. 51, 173, 165/178

See application file for complete search history.

(56) References Cited

U.S. PATENT DOCUMENTS

| | | | | | |
|---|---|---|---|---|---|
| 2,332,450 | A | * | 10/1943 | Mantle | 165/79 |
| 2,511,084 | A | * | 6/1950 | Shaw | 165/166 |
| 3,743,011 | A | * | 7/1973 | Frost | 165/283 |
| 4,134,449 | A | * | 1/1979 | La Haye et al. | 165/83 |
| 4,151,828 | A | * | 5/1979 | Mather et al. | 126/652 |
| 4,274,482 | A | * | 6/1981 | Sonoda | 165/153 |
| 4,291,752 | A | * | 9/1981 | Bridgnell | 165/81 |
| 4,360,057 | A | * | 11/1982 | Koump | 165/82 |
| 4,967,835 | A | * | 11/1990 | Lefeber | 165/167 |
| 5,052,475 | A | * | 10/1991 | Grundy | 165/76 |
| 5,236,043 | A | * | 8/1993 | Armbruster et al. | 165/167 |
| 5,435,383 | A | * | 7/1995 | Rajagopal | 165/167 |
| 5,551,506 | A | * | 9/1996 | Nishishita | 165/81 |
| 5,653,284 | A | * | 8/1997 | Giammaruti et al. | 165/162 |
| 5,894,649 | A | * | 4/1999 | Lambert et al. | 29/890.052 |
| 5,975,197 | A | * | 11/1999 | Kado | 165/149 |
| 6,283,199 | B1 | * | 9/2001 | Nakamura et al. | 165/81 |

FOREIGN PATENT DOCUMENTS

| | | | | |
|---|---|---|---|---|
| EP | 0013800 | * | 8/1980 | 165/153 |
| EP | 000625686 | A2 * | 11/1994 | 165/153 |
| JP | 404309766 | A * | 11/1992 | 165/153 |
| JP | 406159969 | A * | 6/1994 | 165/153 |

OTHER PUBLICATIONS

U.S. Appl. No. 09/652,949, filed Aug. 31, 2000, Yuhung E. Yeh et al.

* cited by examiner

*Primary Examiner*—Tho V. Duong
(74) *Attorney, Agent, or Firm*—Chris James

(57) ABSTRACT

An exemplary heat exchanger includes increased stiffness to prevent buckling of a core. In some examples, an exemplary heat exchanger includes a core and a shaft at least partially positioned therein to increase stiffness of the core and located to limit movement of a heat exchange portion and to receive loads therefrom. In another example, an exemplary heat exchanger includes a core, a duct in fluid communication therewith, a load bearing member positioned adjacent to the core, and a mount which attaches the duct to the member. By connecting the duct to the member, the duct can transfer loads to the load bearing member. This protects the core being damaged by loads applied to the duct. The mount restrains the duct so to transfer loads, from the duct to the load bearing member. Such loads can be from external sources, such as inertia loads and vibration loads.

23 Claims, 10 Drawing Sheets

HEAT EXCHANGER WITH MANIFOLD TUBES FOR STIFFENING AND LOAD BEARING

BACKGROUND OF THE INVENTION

To improve the overall efficiency of a gas turbine engine, a heat exchanger or recuperator can be used to provide heated air for the turbine intake. The heat exchanger operates to transfer heat from the hot exhaust of the turbine engine to the compressed air being drawn into the turbine. As such, the turbine saves fuel it would otherwise expend raising the temperature of the intake air to the combustion temperature.

The heat of the exhaust is transferred by ducting the hot exhaust gases past the cooler intake air. Typically, the exhaust gas and the intake air ducting share multiple common walls, or other structures, which allows the heat to transfer between the two gases (or fluids depending on the specific application). That is, as the exhaust gases pass through the ducts, they heat the common walls, which in turn heat the intake air passing on the other side of the walls. Generally, the greater the surface areas of the common walls, the more heat which will transfer between the exhaust and the intake air.

As shown in the cross-sectional view of FIG. 1, one example of this type of heat exchanger uses a shell 10 to contain and direct the exhaust gases, and a core 20, placed within the shell 10, to contain and direct the intake air. As can be seen, the core 20 is constructed of a stack of thin plates 22 which alternatively channel the inlet air and the exhaust gases through the core 20. That is, the layers 24 of the core 20 alternate between ducting the inlet air and ducting the exhaust gases. In so doing, the ducting keeps the air and exhaust gases from mixing with one another. Generally, to maximize the total heat transfer surface area of the core 20, many closely spaced plates 22 are used to define a multitude of layers 24. Further, each plate 22 is very thin and made of a material with good mechanical and heat conducting properties. Keeping the plates 22 thin assists in the heat transfer between the hot exhaust gases and the colder inlet air.

Typically, during construction of such a heat exchanger, the plates 22 are positioned on top of one another and then compressed to form a stack 26. Since the plates are each separate elements, the compression of the plates 22 ensures that there are always positive compressive forces on the core 20, so that the plates 22 do not separate. The separation of one or more plates 22 can lead to a performance reduction or a failure by an outward buckling of the stack 26. As such, typically the heat exchanger is constructed such that the stack 26 is under a compressive pre-load.

Applying a high pre-load does reduce the potential for separation of the plates 22. However, this approach does have the significant drawback that all the components of the core 20 are placed under a much greater stress than they would be without the pre-loading. In addition, the pre-loading requires that the structure supporting the stack 26 must be much stronger and thus thicker. This pre-load assembly or support structure 40 collectively includes the strongbacks 28, the tie rods 30, as well as the shell 10 structure. This support structure 40 adds to both the weight and the cost of the heat exchanger.

The stack 26 can also be under a further compressive load, which is caused by differential thermal expansion between the core 20 and the support structure 40. As can be seen in FIG. 1, the core 20 is contained in the shell assembly 10.

Because the support structure 40 supports the core 20 and is not a heat transfer medium, the components of the support structure 40 are typically made of much thicker materials than that of the core 20. Unfortunately, this greater thickness causes the support structure 40 to thermally expand at a much slower rate than the quick responding core 20 with its thin plates 22. The thickness (and thus the thermal response) of the support structure 40 will also be affected by the amount of the pre-load applied to the stack 26.

Differential thermal expansion between elements of the heat exchanger will cause a compression load to be applied to the quicker expanding sections (e.g. the core 20 and specifically the stack 26). As noted, a compression load is also applied to the stack 26 by the application of a pre-load. Compressive forces from pre-loading and differential thermal expansion can cause a variety of problems, such as fatigue failures, creep and buckling. Buckling is particularly problematic as it results in the slack 26 expanding outward (laterally) in one or more directions. This outward expansion causes the plates 22 to separate from one another, resulting in a nearly complete destruction of the heat exchanger.

An additional source of loading on the heat exchanger can be from the airflow in the core 20. When the inlet air in the core 20 is pressurized, an additional compressive load is applied to the stack 26. This compression loading can also contribute to the occurrence of buckling or other damage. Air pressure loads can further affect plumbing components in the core including the inlet duct 32 and the outlet duct 34. Loads are also created by the pressure of the air in the ducts that carry the air in and out of the core. The duct will carry this load and transfer it to the core 20. Since the core 20 is made of the thin plates 28, to avoid damage to the core 20, only very limited loads can be applied to the core 20.

In addition, the core 20 can also experience loads caused by external forces. Such forces include inertia loads, which occur in mobile applications, and loads transferred through the ducts from the attached plumbing, such as those caused by turbine vibrations. Inertia loads can be created by accelerations (such as changes in direction or speed) applied to a vehicle in which the heat exchanger is mounted. For example, a vehicle traveling over uneven terrain can cause various inertia loads to be applied to the heat exchanger. Inertia loads increase the likelihood of buckling by providing forces in a variety of directions including those which are aligned with, and perpendicular to, the compressive loads. The aligned inertia loads increase the potential for failure by being additive to the compressive loads. Whereas, the inertia loads directed perpendicular to the compressive loads, increase the likelihood of failure by encouraging the core to buckle to one side or the other. Similarly, the forces that are transmitted through the ducts have the potential to cause failures in the thin plates 20 at locations where the ducts contact the thin plates 28.

As shown in FIG. 2, prior approaches to minimizing differential thermal expansion loads on only the core 20, have included the use of a bellows 36. Bellows function by expanding or contracting to accommodate the relative thermal growth.

Unfortunately, bellows typically have notable drawbacks, including that they are expensive, difficult to assemble and add additional leak paths to the heat exchanger. Such leaks greatly reduce the efficiency of the heat exchanger. Bellows also must be repaired or replaced frequently.

Therefore, a need exists for a heat exchanger that provides sufficient column stiffness for the core structure to prevent buckling and which can carry loads created is by the air pressure within the core. The heat exchanger's increased core column stiffness should significantly reduce the amount of pre-load applied to the core. This in turn will result in reduced structure needed to contain the core, as well as, reduced differential thermal expansion between the core and the shell. The heat exchanger should further be able to accommodate differential thermal growth without the use of a bellows system or other type of variable position linear force system. A heat exchanger with such increased column stiffness will enable the heat exchanger to withstand higher inertia loads. A need further exists for a heat exchanger that can distribute the loads from the ducting into the core structure without causing damage to, or a failure of, the core.

SUMMARY OF THE INVENTION

The present invention provides a heat exchanger with increased stiffness to prevent buckling of the core and which can carry air pressure, duct and inertia loads without damage to the core. In some embodiments, the present invention is a heat exchanger having a core with a heat exchange portion, and a shaft at least partly positioned in the core to increase the stiffness of the core. The shaft is positioned at least adjacent to the heat exchange portion of the core. The shaft is also located to limit movement of the heat exchange portion and to receive loads from the heat exchange portion. The shaft can be positioned through some, or all, of the heat exchange portion of the core.

The heat exchange portion can be a layering of heat exchange members, such that the shaft prevents the members from sliding out away from the core and causing the core to buckle. The shaft is permeable so that a passage in the shaft is in fluid communication with the heat exchange portion of the core. The heat exchanger can also include a load bearing member positioned adjacent the core. In this embodiment, the shaft is mounted to the load bearing member, so that the load bearing member can receive loads from the shaft.

In another embodiment, the heat exchanger includes a core, a duct in fluid communication with the core, a load bearing member positioned adjacent to the core, and a mount which attaches the duct to the load bearing member. By connecting the duct to the load bearing member, the duct can transfer loads to the load bearing member. This load transfer protects the core from being damaged by loads applied to the duct. The mount restrains the duct so to transfer, from the duct to the load bearing member, loads aligned substantially with the longitudinal axis of the duct as well as torsional and shear loads. These loads can include all mechanical loads caused by thermal differentials, air pressure, and other mechanical sources. The mount can also be adjustable to allow the duct to expand separately from the load bearing member. This keeps any differential thermal expansion, occurring between the duct and the load bearing member, from causing damage thereto. The mount can include a motion limiter, a limiter channel, a retainer and a retainer fastener. The duct can extend into the core, and as such, transfer loads over the length of the duct to the core.

In another embodiment of the present invention, the heat exchanger includes a core, a duct extending into the core, a load bearing member and a mount positioned between the duct and the load bearing member. The mount functions to transfer loads from the duct to the load bearing member. The heat exchange portion comprises layers of heat exchange members. The duct passes through at least some of the heat exchange members and can contact the heat exchange members to transfer loads to and from them over the length of the duct. The duct is in fluid communication with the core and is at least adjacent the heat exchange portion of the core. The duct is permeable so that a gas (e.g. air) may pass between the duct and the core. The mount attaches the duct to the load bearing member so that the load bearing member can receive loads from the duct.

DETAILED DESCRIPTION OF DRAWINGS

The present invention increases the stiffness and load carrying capability of a heat exchanger or other similar apparatus. As set forth herein, the present invention has several advantages over prior devices.

The Applicants' invention functions to reduce the potential for core buckling caused by the application of compressive forces as well as duct and inertia loads. Compressive forces can be created by pre-loading, differential thermal expansion, air pressure or other like sources. Whereas duct and inertia loads are typically a result of external forces such as accelerations and vibrations. The reduction in buckling provides the distinct advantage of not only greatly reducing the likelihood that the heat exchanger will be greatly damaged or destroyed, but also allows the heat exchanger to have a simpler structure. Such a simpler structure is cheaper, lighter, easier and potentially quicker to fabricate. In addition, such an improved structure will have a thermal response of the support structure (e.g. the shell, tie rods and strongbacks), which is much nearer to the response of the core. That is, by making the core stiffer, the supporting structure requires less material and the differential between the thermal expansion of the support structure and the core is reduced.

Further, the present invention's superior air pressure load carrying capability reduces loads being transferred to the core structure and allows the elimination of the use of a bellows system. This lack of a bellows results in a reduced potential for damage to the core structure as well as a lowered the possibility of air leaks. The lack of a bellows also reduces the cost and the complexity of the heat exchanger fabrication.

Therefore, the present invention provides a heat exchanger, or other similar apparatus, which is less expensive, easier to manufacture, lighter, less likely to fail (e.g. buckle), more durable, and, due to lower potential for leaks, one which can be much more efficient.

A heat exchanger apparatus which allows for differential thermal expansion of its elements without damage thereto is set forth in U.S. patent application Ser. No. 09/652,949 filed Aug. 31, 2000, entitled HEAT EXCHANGER WITH BYPASS SEAL ALLOWING DIFFERENTIAL THERMAL EXPANSION, by Yuhung Edward Yeh, Steve Ayres and David Beddome, which is hereby incorporated by reference in its entirety.

Figure 3:
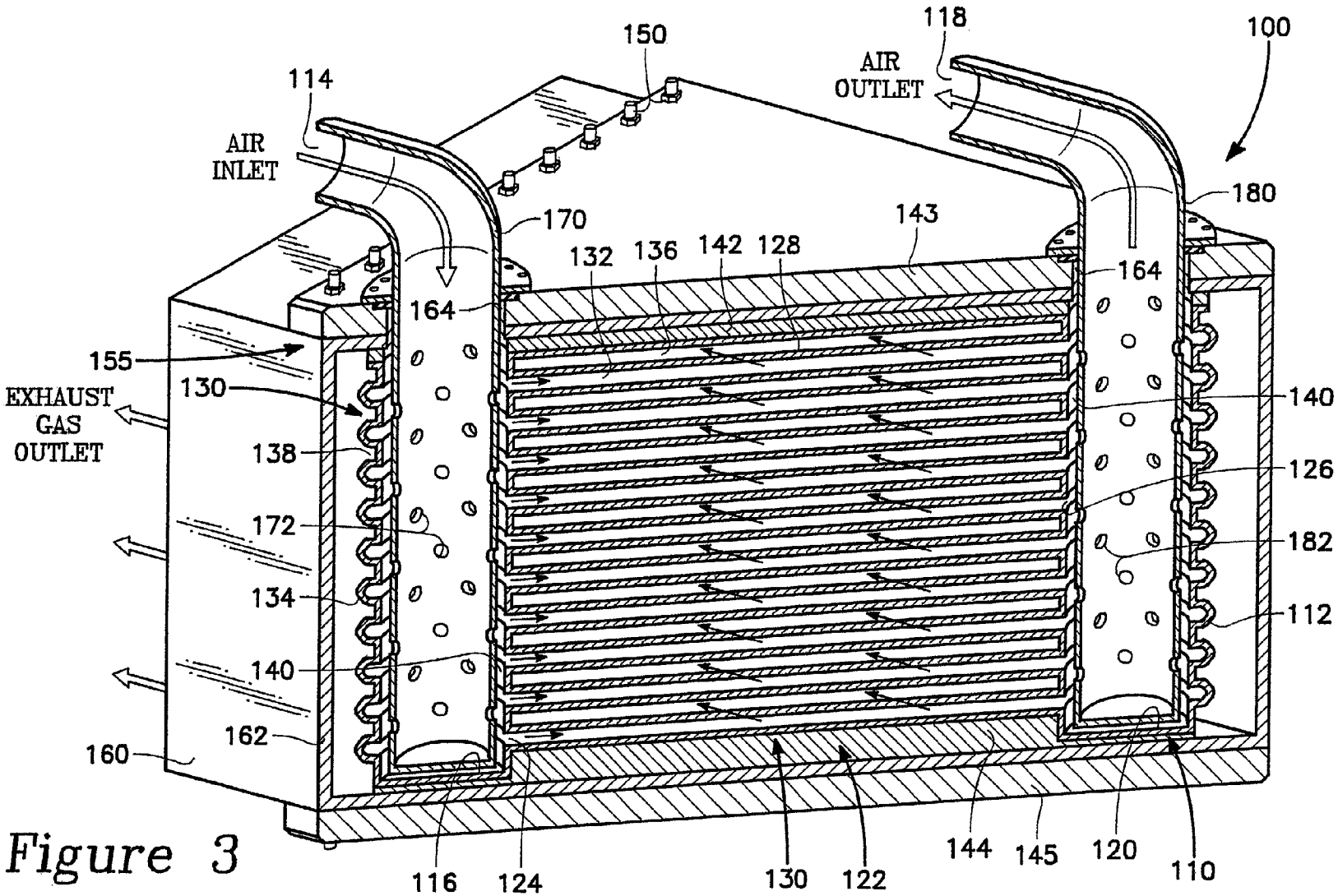
FIG. 3 is an angled side cut-away view of a portion of a heat exchanger in accordance with the present invention.
Figure 4:
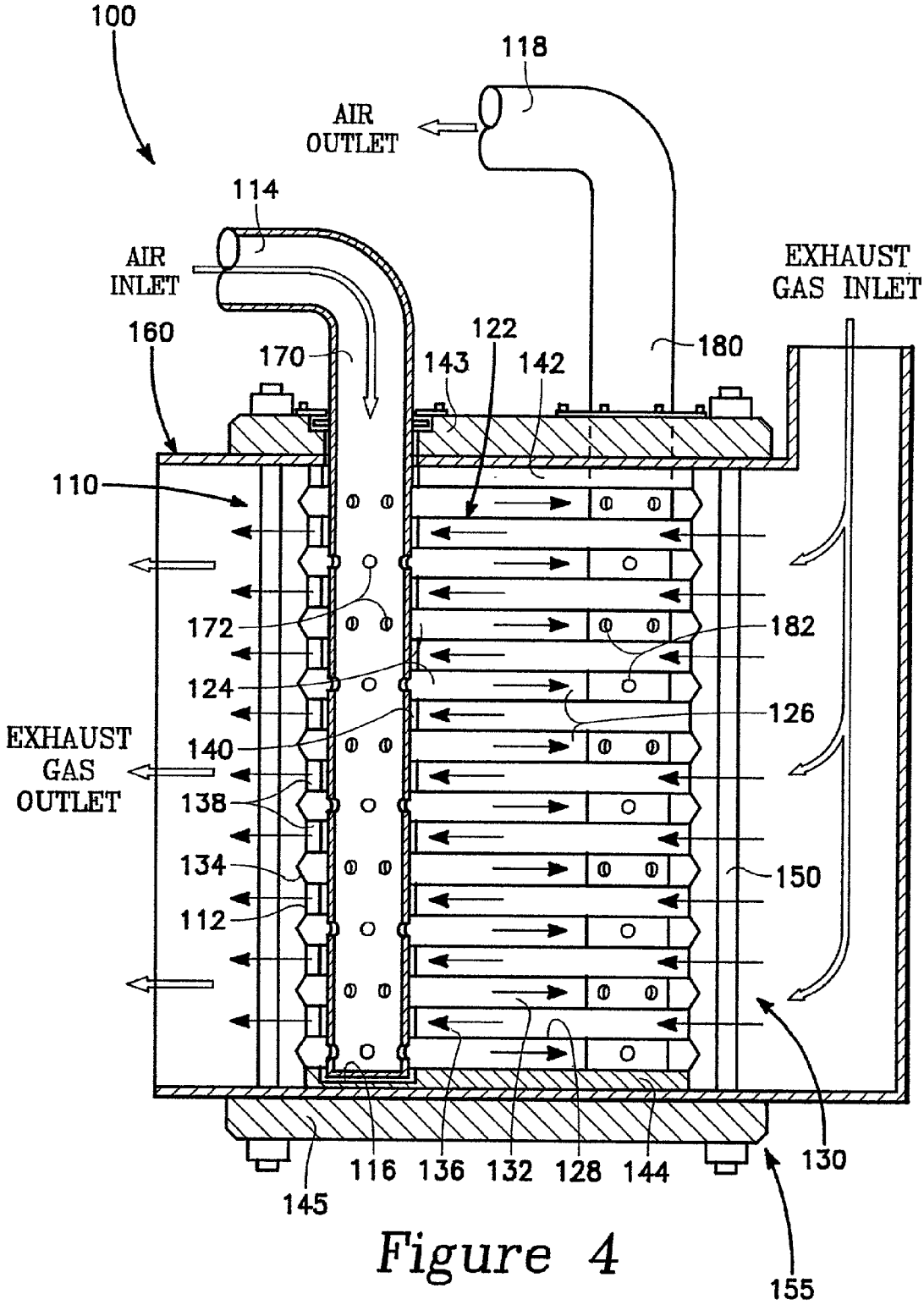
FIG. 4 is a side cut-away view of a portion of a heat exchanger in accordance with the present invention.

For the present invention, as shown in the cut-away views of FIGS. 3 and 4, one embodiment is a heat exchanger 100, having an inlet manifold tube or shaft 170 and an outlet manifold tube or shaft 180 positioned in the core 110 and extending out through the shell assembly 160.

The core 110 is positioned within the shell 160. The core 110 functions to duct the inlet air past the exhaust gas, so that the heat of the exhaust gas can be transferred to the cooler inlet air. The core 110 performs this function while keeping the inlet air separated from the exhaust gas, such that there is no mixing of the air and the gas. Keeping the air and gas separate is important, as the mixing of the two will result in reduced efficiency, and potentially diminished engine performance.

As shown in FIGS. 3 and 4, the core 110 has an exterior surface 112. An air inlet 114 and an air outlet 118 bring air into and out of the core 110. The air inlet 114 receives relatively cool inlet air for passage through the core 110. When the heat exchanger 100 is operating, the air exiting the air outlet 118 will have a much higher temperature than the inlet air, having been heated in the core 110. Between the air inlet 114 and the air outlet 118 are the inlet manifold tube 170, a heat exchange region 122 and the outlet manifold tube 180. As can be seen, the inlet manifold tube 170 is positioned in the inlet manifold 116 and the outlet manifold tube 180 is positioned in the outlet manifold 120 (which is not shown in FIG. 4). Preferably, the tubes 170 and 180 are perforated, or otherwise permeable to allow air to flow in and out of them. The tubes 170 and 180 carry the air through central passages defined within the tubes.

The heat exchange region 122 can be any of a variety of configurations that allow heat to transfer from the exhaust gas to the inlet air, while keeping the gases separate. However, it is preferred that the heat exchange region 122 be a prime surface heat exchanger having a series of layered plates 128, which form a stack 130. The plates 128 are arranged to define heat exchange members or layers 132 and 136 which alternate from ducting air, in the air layers 132 to ducting exhaust gases, in the exhaust layers 136. These layers typically alternate in the core 110 (e.g. air layer 132, gas layer 136, air layer 132, gas layer 136, etc.). Separating each layer 132 and 136 is a plate 128.

On either end of the stack 130 are a first end plate 142 and a second end plate 144. The first end plate 142 is positioned against the upper portion of the shell assembly 160 and the second end plate 144 is positioned against the lower portion of the shell assembly 160. Depending on the specific needs of the use of the heat exchanger 100 of present invention (e.g. required pre-loads, forces exerted on the stack 130, compression of the plates 128 of the stack 130, and the like), a series of tie rods 150 and an upper strongback or load bearing member 143 and a lower strongback or load bearing member 145, can be used to hold the stack 130 together and carry loads. On the outside of the shell 160 and above and below the core 110, are the upper strongback 143 and the lower strongback 145. The tie rods 150 and the strongbacks 143 and 145 (as well as the shell 160) carry compressive loads applied to the stack 130. These compressive loads can be from a variety of sources including pre-loading, differential thermal expansion, air pressure, and the like. The upper strongback 143, the lower strongback 145, the tie rods 150, as well as the shell 160, collectively form a support structure 155 which functions to apply the compressive force to the stack 130 of the core 110.

As can be seen, the plates 128 are generally aligned with the flow of the exhaust gas through the shell assembly 160. The plates 128 can be made of any well known suitable material, such as steel, stainless steel or aluminum, with the specific preferred material dependent on the operating temperatures and conditions of the particular use. The plates 128 are stacked and connected (e.g. welded or brazed) together in an arrangement such that the air layers 132 are closed at their ends 134. With the air layers 132 closed at ends 134, the core 110 retains the air as it passes through the core 110. The air layers 132 are, however, open at air layer intakes 124 and air layer outputs 126. As shown in FIGS. 3 and 4, the air layer intakes 124 are in communication with the inlet manifold 116, so that air can flow from the air inlet 114 through the inlet manifold tube 170 and into each air layer 132. Likewise, the air layer outputs 126 are in communication with the outlet manifold 120, to allow heated air to flow from the air layer 132 through the outlet manifold tube 180 and out the outlet 118.

In contrast to the air layers 132, the gas layers 136 of the stack 130 are open on each end 138 to allow exhaust gases to flow through the core 110. Further, the gas layers 136 have closed or sealed regions 140 located where the layers 136 meet both the inlet manifold 116 and the outlet manifold 120. These closed regions 140 prevent air, from either the inlet manifold 116 or the outlet manifold 120, from leaking out of the core into the gas layers 136. Also, the closed regions keep the exhaust gases from mixing with the air.

Therefore, as shown in FIGS. 3 and 4, the intake air is preferably brought into the core 110 via the inlet manifold tube 170, distributed along the stack 130 by passing through openings 172 in the tube 170, passed through the series of air layer intakes 124 into the air layers 132, then sent through the air layers 132 (such that the air flows adjacent—separated by plates 128—to the flow of the exhaust gas in the gas layers 136), exited out of the air layer 132 at the air layer outputs 126 into the outlet manifold tube 110 by the openings 182, and then out of the core 110. In so doing, as the air passes through the core 110 it receives heat from the exhaust gas.

With the stack 130 arranged as shown in FIGS. 3 and 4, the hot exhaust gas passes through the core 110 at each of the gas layers 136. The exhaust gas heats the plates 128 positioned at the top and bottom of each gas layer 136. The heated plates 128 then, on their opposite sides, heat the air passing through the air layers 132.

As the plates 128 and the connected structure of the core 110 heat up, they expand. This results in an expansion of the entire stack 130 and thus of the core 110. As noted, this expansion is faster than the expansion of the supporting structure 155 (the shell 160, strongbacks 143 and 145 and the tie rods 150). This differential expansion causes a compression force to be applied to the core 110. As noted in detail below, the inlet manifold tube 170 and outlet manifold tube 180, function to increase the stiffness of the core 110 and reduce the likelihood that the core 110 will buckle under compression forces caused by the differential expansion and by other sources.

Although the core 110 can be arranged to allow the air to flow through it in any of a variety of ways, it is preferred that the air is channeled so that it generally flows in a direction opposite, or counter, to that of the flow of the exhaust gas in the gas layers 136 (as shown in the cross-section of FIG. 4). With the air flowing in an opposite direction to the direction of the flow of the exhaust gas, it has been found by the Applicants that the efficiency of the heat exchanger is significantly increased.

The arrangement of the core 110 can be any of a variety of alternative configurations. For example, the air layers 132 and gas layers 136 do not have to be in alternating layers, instead they can be in any arrangement which allows for the exchange of heat between the two layers. For example, the air layers 132 can be defined by a series of tubes or ducts running between the inlet manifold tube 170 and the outlet manifold tube 180. While the gas layers 136 are defined by the space outside of, or about, these tubes or ducts. Of course, the heating of such a configuration of the core will still result in differential expansion between the core and the support structure. Therefore, the manifold tubes 170 and 180 are utilized to increase the stiffness of the core and in so doing reduce the chance of a buckling failure occurring.

The core 110 can also include secondary surfaces such as fins or thin plates connected to the inlet air side of the plates 128 and/or to the exhaust gas side of the plates 128. The core 110 and shell 160 can carry various gases, other than, or in addition to, those mentioned above. Also, the core 100 and shell 160 can carry any of a variety of fluids.

The shell assembly 160 functions to receive the hot exhaust gases, channel them through the core 110, and eventually direct them out of the shell 160. The shell 160 is relatively air tight to prevent the exhaust gas from escaping, or otherwise leaking out of, the shell 160. The shell 160 is large enough to contain the core 110.

The shell 160 also has openings 164 for the inlet manifold tube 170 and the outlet manifold tube 180. The shell assembly 160 can be made of any suitable well known material including, but not limited to, steel and aluminum. Preferably, the shell 160 is a stainless steel.

Because the shell assembly 160 can carry a variety of loads (both internally and externally exerted), and since the shell 160 does not need to transfer heat, its walls 162 are thick relative to the thin core plates 128. As previously noted, this greater thickness causes the shell 160 to thermally expand at a much slower rate than the core 110. This results in a significant amount of differential thermal expansion between the support structure 155 and the core 110, as the two are heated or cooled. The Applicants' present invention provides for this differential expansion by employing the manifold tubes 170 and 180 to increase the stiffness and load carrying capability of the core 110. As shown herein, the manifold tubes 170 and 180 can have any of a variety of embodiments.

As shown in FIGS. 3 and 4, in at least one embodiment, the manifold tubes 170 and 180 are cylinders, which extend through the core 110 and up out of the shell 160. The manifold tubes 170 and 180 function to increase the stiffness of the structure of the core 110 and to carry loads exerted on the core 110 as well as loads exerted directly on the tubes 170 and 180. Increasing the stiffness of the core 110 greatly reduces the potential for core buckling.

The manifold tubes 170 and 180 are continuous structural members, which run through all of the core plates 128. As such, in the event some plates 128 are forced or begin to move outwards, as would occur if the core 110 started to buckle, one or both of the manifold tubes 170 and 180 will carry the loads and prevent any of the plates 128 from moving from their original positions.

This load carrying ability of the manifold tubes 170 and 180 allows the core 110 to be subjected to significantly higher compressive loads than it otherwise would. As such, with use of the manifold tubes 170 and 180, the core 110 can be placed under higher air pressures and have a faster thermal expansion than that of the support structure 155. Further, because the core 110 can accommodate greater loads and has a higher stiffness, the amount of pre-load placed on the core 110 can be reduced. With less pre-loading necessary, the support structure 155 can be reduced in size. This results in a heat exchanger that is less expensive, lighter and easier to fabricate.

The manifold tubes 170 and 180 also function to carry and transfer loads applied to them. One such load is that generated by the airflow into and out of the core 110. For example, loads on one or both of the manifold tubes 170 and 180 can be generated by turning the airflow as it enters or exits the core 110. Changes in the speed and pressure of the airflow can also create loads on the tubes 170 and 180. These loads can be applied to the manifold tubes 170 and 180 in both longitudinal and lateral directions.

One problem with loads being applied to inlet and outlet ducting is that a transfer of some or all of the loads to the core 110 can easily result in significant damage to the core 110. As noted above, the plates 128 of the core 110 are kept very thin to facilitate the transfer of heat between the hot exhaust gas and the air. As such, the plates 128 lack the structure required to carry any significant load, and are therefore very susceptible to damage. Clearly, damage such as buckling or any deformation to the core 110 can greatly reduce the performance of the heat exchanger 100, or even cause its complete failure. Not only can the air or gas flows be disrupted or blocked, but also in the event of a separation or tear in the plates, the air and exhaust gas flows can mix together.

Figure 1:
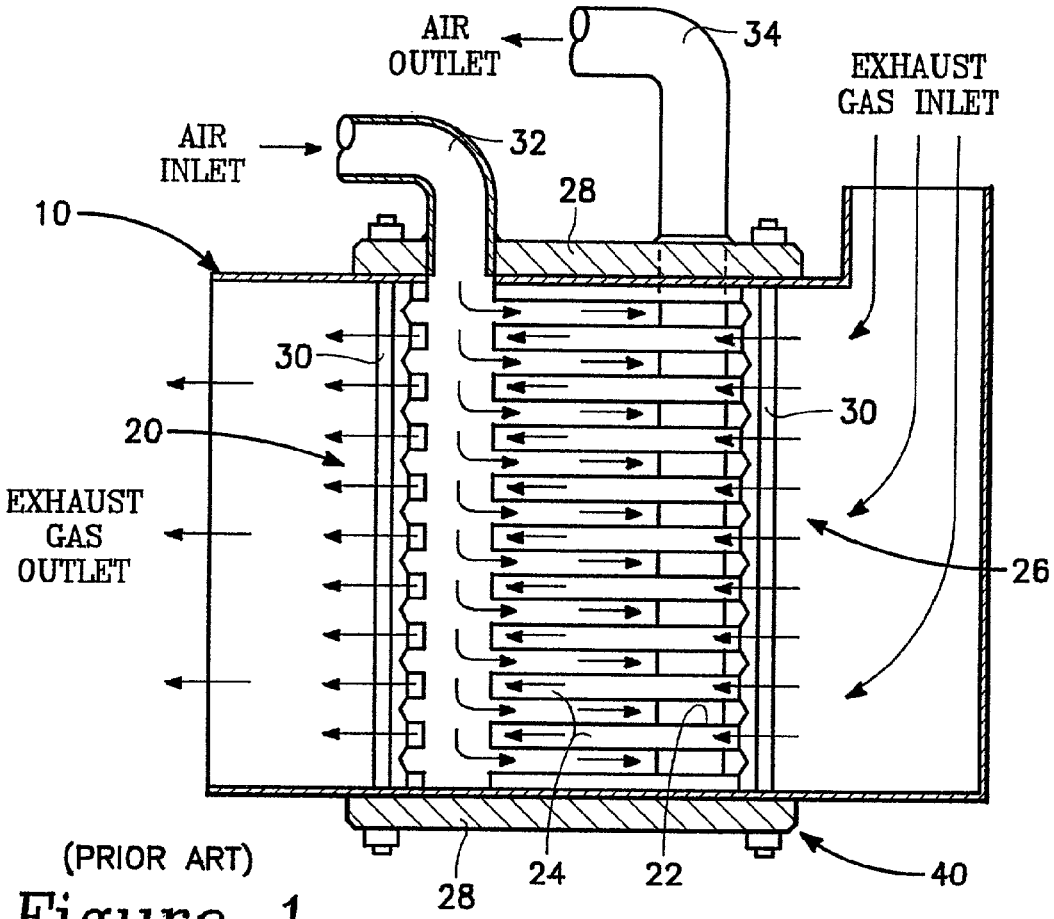
(PRIOR ART) Figure 1
FIG. 1 is a side cut-away view of a portion of a heat exchanger.
Figure 2:
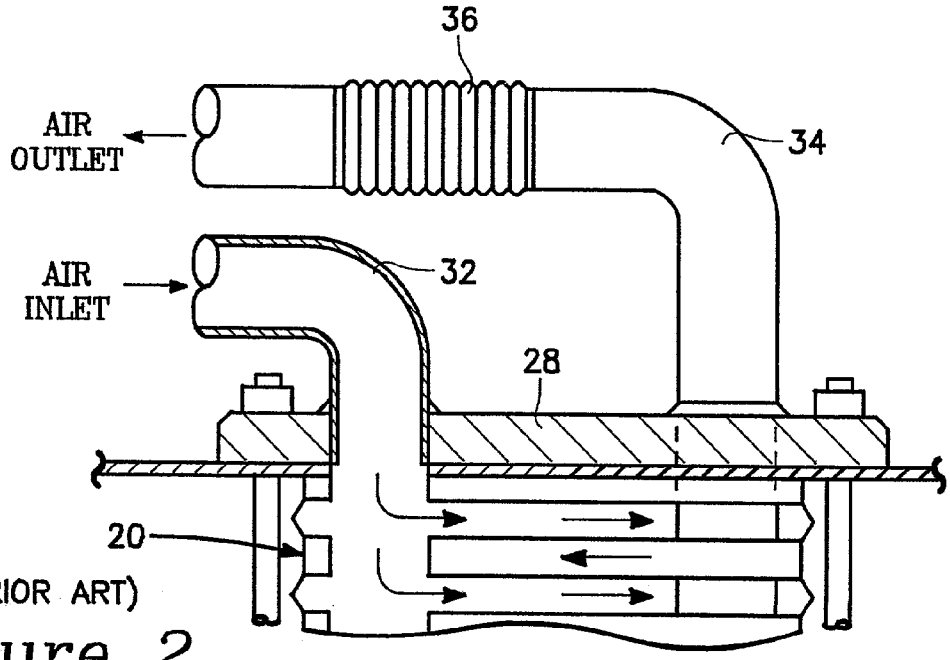
(PRIOR ART) Figure 2
FIG. 2 is a side cut-away view of a portion of a heat exchanger.

As noted above, prior devices attempted to alleviate airflow loads by using a bellows system, as shown in FIG. 2. The bellows 36 functioned by simply expanding and contracting to accommodate changes in the airflow and pressure. In so doing, the bellows 36 helped reduce loads that would otherwise be applied to the core 20. Unfortunately, the bellows were expensive, complex, wore-out quickly and commonly leaked.

Figure 5:
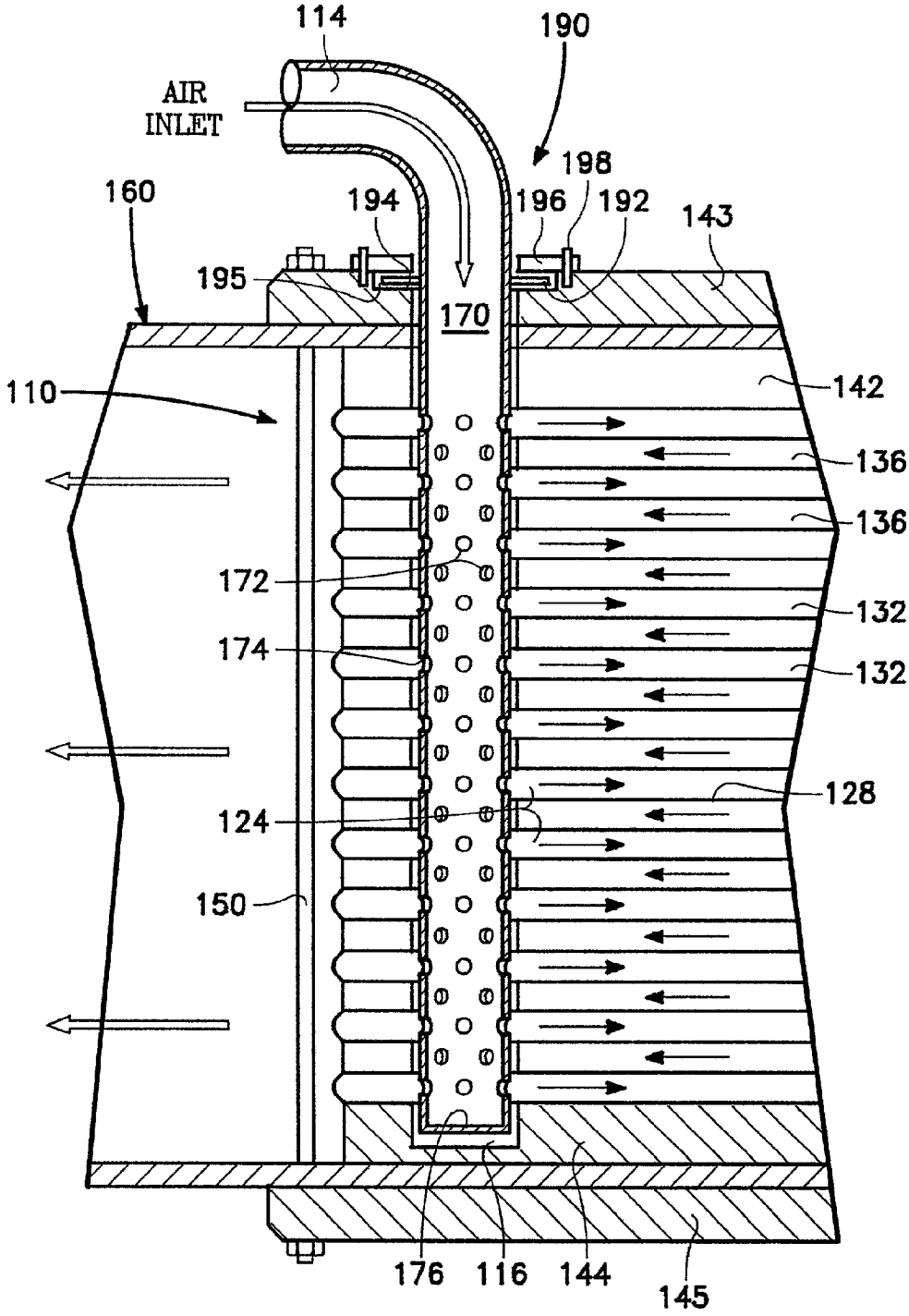
FIG. 5 is a side cut-away view of a portion of a heat exchanger in accordance with the present invention.

In contrast, the manifold tubes of the Applicants' invention transfer loads without damaging the core of the heat exchanger. This load transfer can be accomplished in a variety of ways. As shown in FIG. 5, and as described in further detail below, the manifold tubes 170 and 180 can be secured to the upper strongback 143, so to transfer forces and moments from the tubes 170 and 180 directly to the upper strongback 143. Because one function of the upper strongback 143 is to carry compression loads applied to the core 110 (e.g. due to pre-loading, differential expansion, air pressure and the like), the upper strongback 143 typically sufficiently strong to also carry the forces and moments from the tubes 170 and 180. This allows the upper strongback 143, rather than the core 100, to carry most, if not all, of the loads applied to the tubes 170 and 180. This, of course, greatly reduces the potential for damage to the core 110.

Nevertheless, the tubes 170 and 180 can also transfer loads directly to the core 110. The relatively long length of the tubes 170 and 180 allows loads to be transferred over a large area along the core 110. As such, the amount of force applied to any given area of the core 110 is minimized. In addition, the length of the tubes 170 and 180 creates a long moment arm, which acts to reduce the forces applied to the core 110. In this manner loads can be transferred to the core 110 without causing damage.

The manifold tubes 170 and 180 can also transfer loads to the core by being directly attached to the core 110. Specifically, by welding, brazing or otherwise attaching the tubes 170 and 180 to the core 110. In this manner, the core 110 can receive vertical loads (i.e. aligned with the longitudinal axis of the tubes 170 and 180), as well as horizontal loads (i.e. lateral to the longitudinal axis). The tubes 170 and 180 can be mounted to the core 110 in a variety of different ways and to various components of the core 110. For example, the tubes 170 and 180 can be brazed to the end plates 142 and 144 and/or to some or all of the core plates 128.

Figure 6:
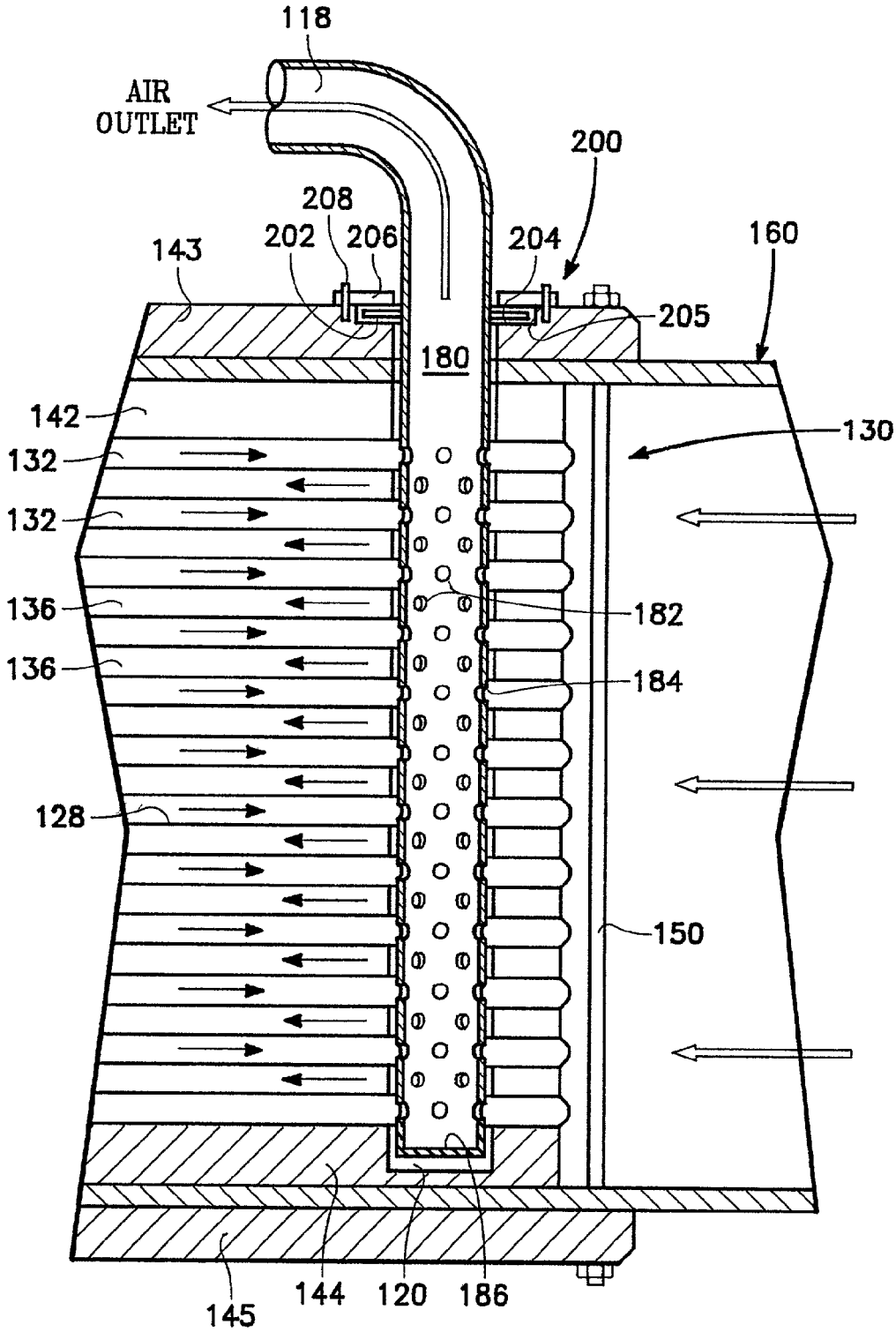
FIG. 6 is a side cut-away view of a portion of a heat exchanger in accordance with the present invention.

As shown in FIGS. 3, 4 and 5, the inlet manifold tube 170 is positioned within the inlet manifold 116. Likewise, as shown in FIGS. 3 and 6, the outlet manifold tube 180 is positioned within the outlet manifold 120. While the tubes 170 and 180 can be of any of a variety of lengths and widths, they are, of course, limited by the length and width of the manifold into which they are received. Preferably, the manifold tubes 170 and 180 are sized to extend along the entire length of the manifolds 116 and 120 (respectfully) and fit with minimal clearance into the manifolds 116 and 120. In some embodiments, the manifold tubes 170 and 180 are in direct contact with the sides of the manifolds 116 and 120 (e.g. the edges of the plates 128).

As shown in FIGS. 5 and 6, the manifold tubes 170 and 180 can vary in the thickness of their walls 174 and 184 (respectfully). The specific thickness used will depend on the requirements of the particular use. That is, the more compressive load which will be applied to the core 110 during use, the stronger, and thus thicker the tube walls 174 and 184 will have to be to prevent buckling or other damage to the core 110. Thickness will also depend on the material used for the tubes 170 and 180. Any of a variety of materials can be used for the tubes 170 and 180, including steel and aluminum. However, the preferred material for the tubes 170 and 180 is a stainless steel. The specific thickness of the tubes 170 and 180 required to prevent, or at least sufficient limit the potential for core buckling, or other such damage, can be determined by one skilled in design of such structures, using well known analytical and/or empirical methods.

FIGS. 5 and 6 also show openings 172 and 182 in the walls 174 and 184 of the manifold tubes 170 and 180 (respectfully). The openings 172 in the inlet manifold tube 170 function to allow the air to pass out of the tube 170 and into the adjacent air layer intakes 124, as shown in FIG. 5. Likewise, as set out in FIG. 6, the openings 182 in the outlet manifold tube 180 allow the air to from the air layer outputs 126 into the tube 180. The size, arrangement, spacing and number of openings are dependent upon the specifics of the particular use of the heat exchanger 100. Some of the factors which can affect the configuration of the openings 172 and 182, include the amount of airflow through the core 110, the spacing and size of the air layer intakes 124 and outputs 126, the desired distribution of air through the air layers 132 (e.g. larger openings where more airflow is needed), and the required strength of the manifold tubes 170 and 180. As with other aspects of the design of the tubes 170 and 180, the specific configuration of openings 172 and 182 can be determined by one skilled in design of such structures, using well known analytical and/or empirical methods. Even though many alternatives are available for the shape of the openings 172 and 182, it is preferred that the openings 172 and 182 be circular, as shown in FIGS. 5 and 6.

Many variations on the configuration, construction and arrangement of the manifold tubes 170 and 180 are possible. The tubes 170 and 180 can not only extend along the entire length of the manifolds 116 and 120 (as shown in FIGS. 3–6), but also be shorter and extend over just a portion of the manifolds' length. The width of the tubes 170 and 180 can also be smaller than that of the manifolds 116 and 120, such that there exists a space between the tubes 170 and 180 and the sides of the manifolds 116 and 120. The shape of the tubes 170 and 180 do not have to be round or cylindrical. Other shapes for the tubes 170 and 180 can also be employed, including square, rectangular, triangular, oval or other polygonal cross-sections. The tubes 170 and 180 also do not have to have constant cross-sections. That is, a cone or similar shape can be used. In addition, the tubes 170 and 180 can be opened or closed at their bottom ends 176 and 186.

The manifold tubes 170 and 180 can be attached to the strongback 143 in any of a variety of embodiments to allow loads applied to the tubes 170 and 180 to be transferred to the strongback 143. As noted above, since the strongback 143 has a higher strength and stiffness relative to the core 110, transferring loads to the strongback 143 reduces or eliminates the likelihood that the core 110 will be damaged.

As shown in FIGS. 5 and 6, an inlet mount 190 and an outlet mount 200 are used to take up axial and blow off loads to core. The inlet and outlet mounts 190 and 200 attach the inlet and outlet manifold tubes 170 and 180 (respectively) to the strongback 143. As can be seen in FIG. 5, the inlet mount 190 includes an inlet motion limiter 192, an inlet limiter channel 194, an inlet retainer 196 and an inlet retainer fastener 198.

The mount 190 functions both to transfer loads from the inlet tube 170 to the strongback 143 and to allow a limited amount of movement of the inlet tube 170 relative to the strongback 143. Allowing limited movement of the inlet tube 170 facilitates differential thermal expansion between the tube 170 and the strongback 143. Because the inlet manifold tube 170 is a very thin (relatively) sheet structure, when heated or cooled it will expand or contract much quicker than the substantially thicker structure of the strongback 143. By providing an expansion space 195 for this differential expansion, the mount 190 prevents the application of loads that could otherwise be generated by a mount that restrains the differential expansion. Such retraining can cause structural damage due to deformations, buckling, fatigue failures and creep. It is preferred that the inlet manifold tube 170 is welded to the first end plate 142.

As shown in FIG. 5, the inlet motion limiter 192 is mounted to the inlet manifold tube 170. The motion limiter 192 functions to restrain the vertical movement of inlet tube 170 and to limit horizontal movement of the tube 170. Limiting vertical movement of the tube 170 is important, since with the core 110 pressurized, the tube 170 will be under a force urging it outward from the core 110. Such an outward force is generally directed along a longitudinal axis of the tube 170 or axially along the tube 170. The motion limiter 192 is a ring of material attached to the tube walls 174 about the tube 170. The motion limiter 192 can be any of a variety of materials including steel and aluminum, however stainless steel is preferred. The motion limiter 192 can be attached to the tube 170 by many different means including welding and brazing.

Configurations other than those shown in FIG. 5, for the motion limiter 192 are possible. For example, the motion limiter 192 alternatively can be a set of plates, rods or the like, extending from about the inlet tube 170. The specific size, structure and mounting of the motion limiter 192 are dependent on the particular heat exchanger design in which it is employed. For example, the size of the inlet motion limiter 192 is dependent on the amount of differential expansion between the inlet tube 170 and the strongback 143 as well as the size of the inlet limiter channel 194 into which the motion limiter 192 is received. Likewise, the structure and mounting of the motion limiter 192 is dependent on the loads that need to be transferred from the inlet tube 170 to the strongback 143. Determination of the specifics of size, structure and mounting for the inlet motion limiter 192 can be determined by one skilled in design of such structures using well known analytical and/or empirical methods.

The inlet limiter channel 194 is set into the strongback 143 and receives the inlet motion limiter 192. The limiter channel 194 functions to retain the motion limiter 192 while providing sufficient space for the differential thermal expansion, as noted above. The depth of the channel 194 preferably is sufficiently close to the thickness of the limiter 192 to retain the vertical movement of the inlet tube 170, but with enough clearance to allow substantially unrestricted horizontal movement of the inlet tube 170 due to thermal expansion. Such horizontal movement can be received by the expansion space 195. Alternative configurations of the limiter channel 194 are possible. For example, the limiter channel 194 can instead be on the surface of the strongback 143 and be defined by the inlet retainer 196 positioned about it.

As shown in FIG. 5, the inlet retainer 196 is positioned over both the limiter channel 194 and the motion limiter 192. The retainer 196 functions to keep the motion limiter 192 in the limiter channel 194 and, in so doing, prohibits vertical movement of the inlet tube 170 in the case that the inlet tube's motion limiter 192 is in contact with the inlet retainer 196.

The inlet retainer fastener 198 functions to mount the inlet retainer 196 to the strongback 143. As shown in FIG. 5, in this embodiment the fastener 198 is a set of bolts, which pass through the retainer 196 and into the strongback 143. However, other configurations of the fastener 198 are available.

Like the inlet mount 190, the outlet mount 200 functions to transfer loads from the outlet tube 180 to the strongback 143, while limiting vertical movement of the tube 180 and allowing for differential thermal expansion between the tube 180 and the strongback 143. FIG. 6 shows one embodiment of the outlet mount 200. The outlet mount 200 includes an outlet motion limiter 202, an outlet limiter channel 204, an outlet retainer 206 and an outlet retainer fastener 208. By providing an expansion space 205 for differential thermal expansion, the mount 200 prevents the application of loads, which could otherwise be generated by restraining the differential thermal expansion. It is preferred that the outlet manifold tube 180 is welded to the first end plate 142.

Figure 7:
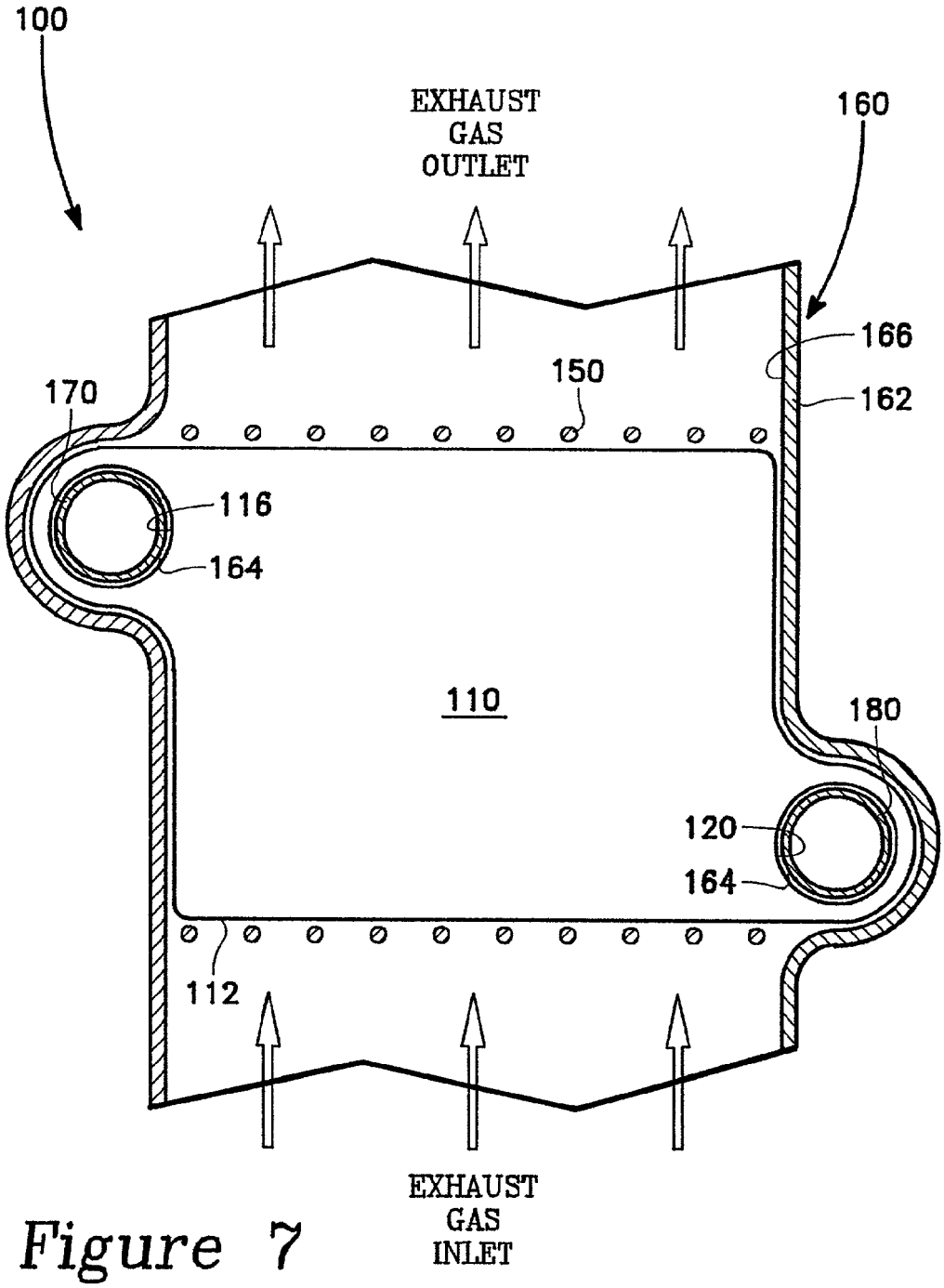
FIG. 7 is a top cut-away view of a portion of a heat exchanger in accordance with the present invention.

FIG. 7 is a top cut-away view of one embodiment of the heat exchanger 100. As can be seen, the inlet manifold tube 170 and the outlet manifold tube 180 are set in the core 110, and positioned in the shell 160 to the sides. This positioning allows the tubes 170 and 180 to be out of the direct flow of the exhaust gas passing through the core 110, resulting in improved gas flow through the core 110.

Many alternative configurations of the heat exchanger 100 exist. For example, instead of using both the inlet manifold tube 170 and the outlet manifold tube 180, the heat exchanger 100 can use just one of the two. Likewise, more than two manifold tubes can be used. In fact, in some embodiments, one or more of the manifold tubes function to direct the air with limited or no load bearing capability, while other manifold tubes function primarily as load bearing members.

Figure 8:
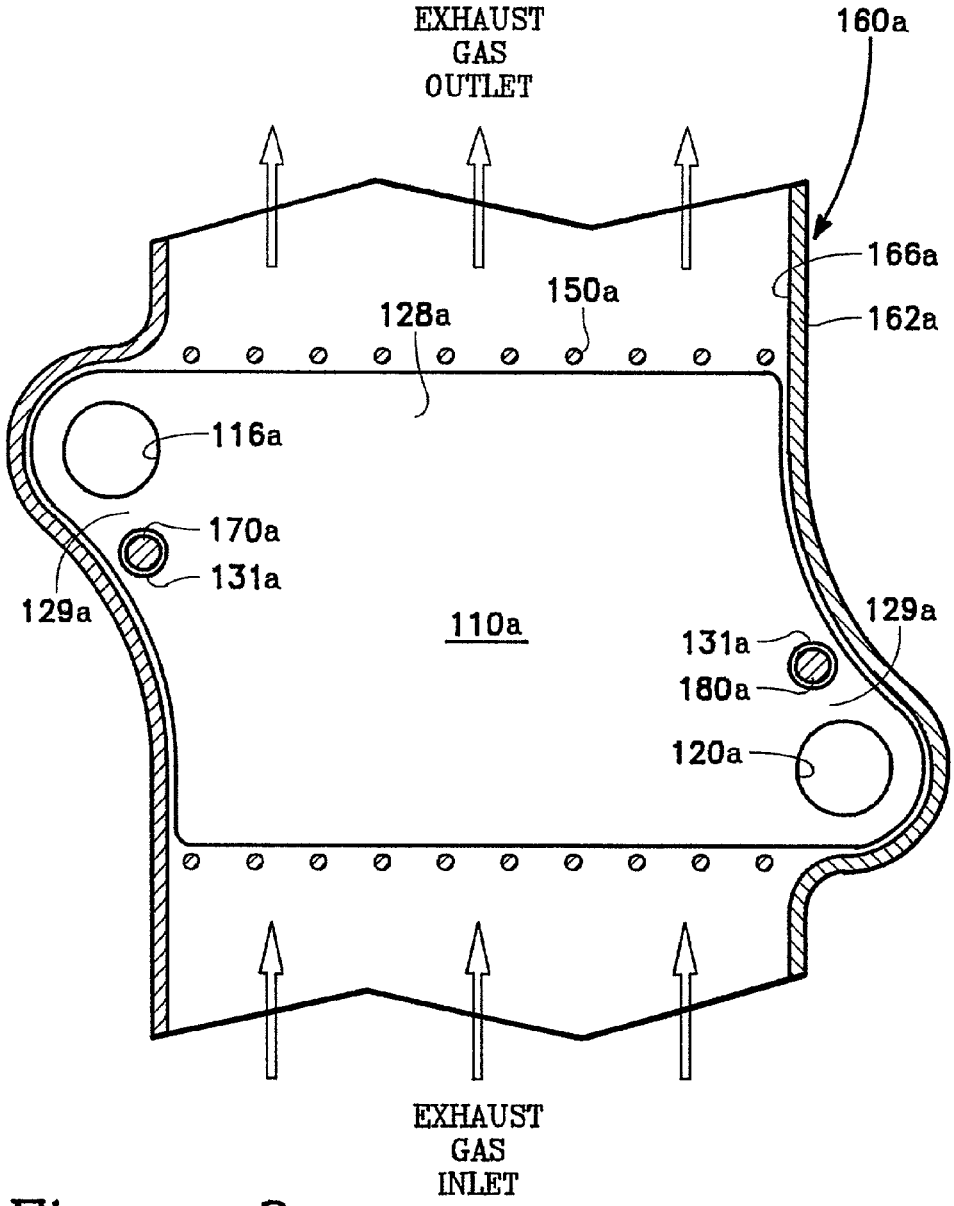
FIG. 8 is a top cut-away view of a portion of a heat exchanger in accordance with the present invention.

As shown in the top cut-away view in FIG. 8, in at least one embodiment of the present invention, an inlet tube or support shaft 170*a* and an outlet tube or support shaft 180*a* are positioned near the inlet manifold 116*a* and outlet manifold 120*a*, respectfully, but are not in the manifolds themselves. Instead, the support shafts 170*a* and 180*a* are positioned in an extended portion 129*a* of the plates 128*a* through holes 131*a*. The portion 129*a* is an area of the plates 128*a* which is extended outward (as compared to other embodiments of the heat exchanger such as that shown in FIG. 7 and described above), to provide space for the shafts 170*a* and 180*a*. In this way the shafts 170*a* and 180*a* can be positioned out of the flow of the exhaust gas passing through the core 110. Preferably, the support shafts 170*a* and 180*a* are solid and do not transfer air through them, as is the case with the tubes 170 and 180 in other embodiments (e.g. as shown in FIGS. 3–7). As can be seen, in the embodiment shown in FIG. 8, air is carried in and out of the core 100*a* by the inlet manifold 116*a* and the outlet manifold 120*a*. The support shafts 170*a* and 180*a* function to prevent buckling of the core 110*a* by increasing its stiffness, to bear and transfer loads, and prevent the plates 128*a* from being displaced from their original positions. The support shafts 170*a* and 180*a* can be attached to the plates 128*a* by welding, brazing or any other similar well known method. In other embodiments, several shafts 170*a* and shafts 180*a* are positioned about the plate 128*a* perimeter. The specific configuration of the shafts 170*a* and 180*a* are dependent on the particular use, which the heat exchanger is used. Generally, the greater core stiffness necessary for a certain use, the larger shafts 170*a* and 178*a* used will be. The size, shape, strength, material and other aspects of the shafts 170*a* and 180*a* can be determined by one skilled using well known empirical and/or analytical methods.

Figure 9:
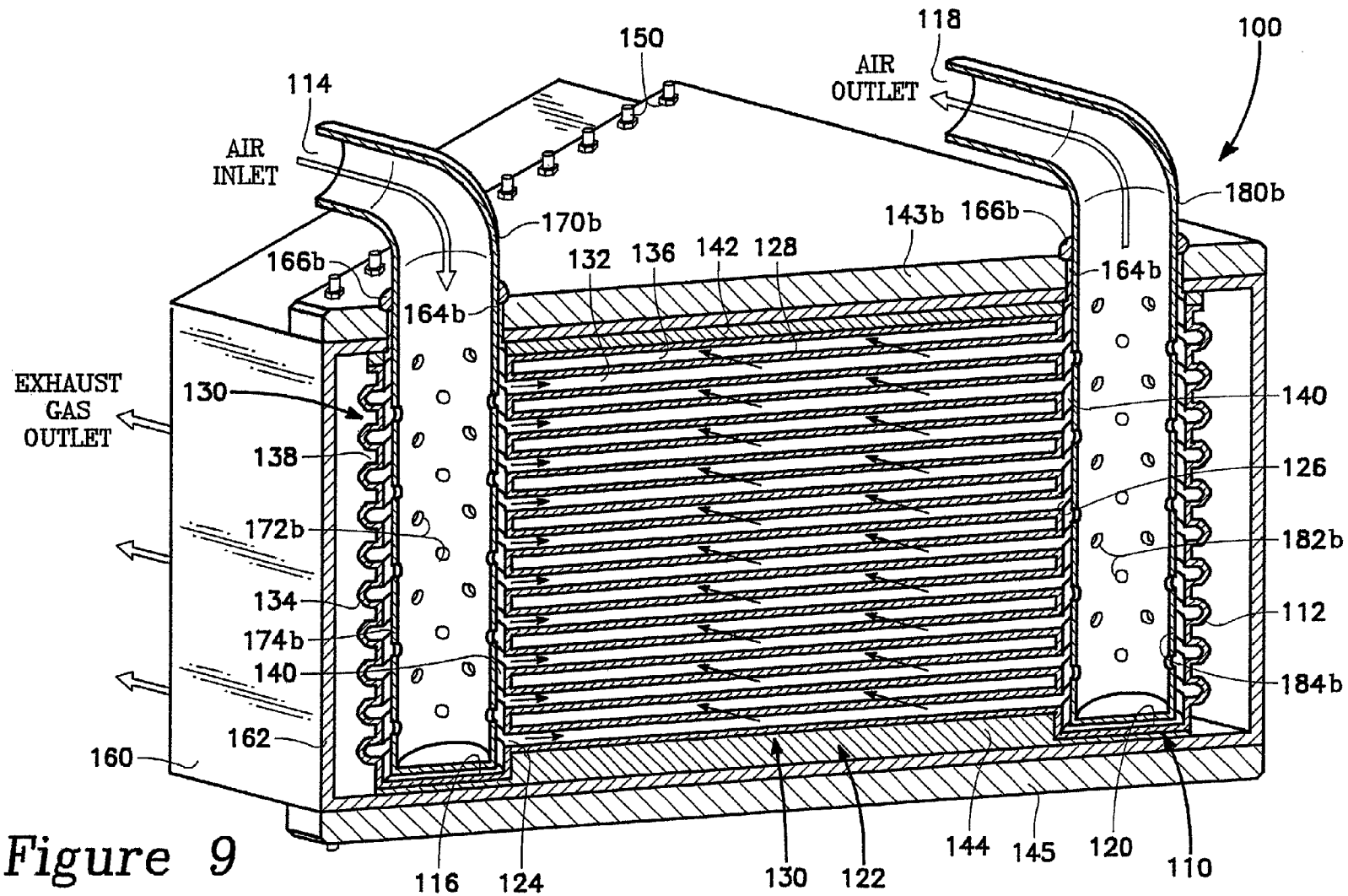
FIG. 9 is an angled side cut-away view of a portion of a heat exchanger in accordance with the present invention.

As shown in FIG. 9, in other embodiments of the present invention, one or both of the inlet and outlet manifold tubes 170*b* and 180*b* of the heat exchanger 100 are not mounted to the strongback 143*b* as described in the embodiments above. Instead, in these embodiments of the invention, the tubes 170*b* and 180*b* either are simply attached by welding, brazing or the like, at the opening 164*b* of the strong back 143*b*. As shown in FIG. 9, a weld 166*b* can be used to attach the tubes 170*b* and 180*b* to the strongback 143*b*. In another embodiment, the manifold tubes pass through the strongback without being mounted thereto. Such embodiments of the manifold tubes 170*b* and 180*b* function to increase the stiffness of the core 110 and reduce buckling by not only limiting the outward movement of the plates 128 but also by carrying loads transferred from the plates 128. Further, airflow loads applied to the tubes 170*b* and 180*b* can be transferred by being applied along the length of the core 110. If the tubes 170*b* and 1180*b* are attached to the strongback 143*b*, loads can also be transferred to strongback 143*b*.

Figure 10A:
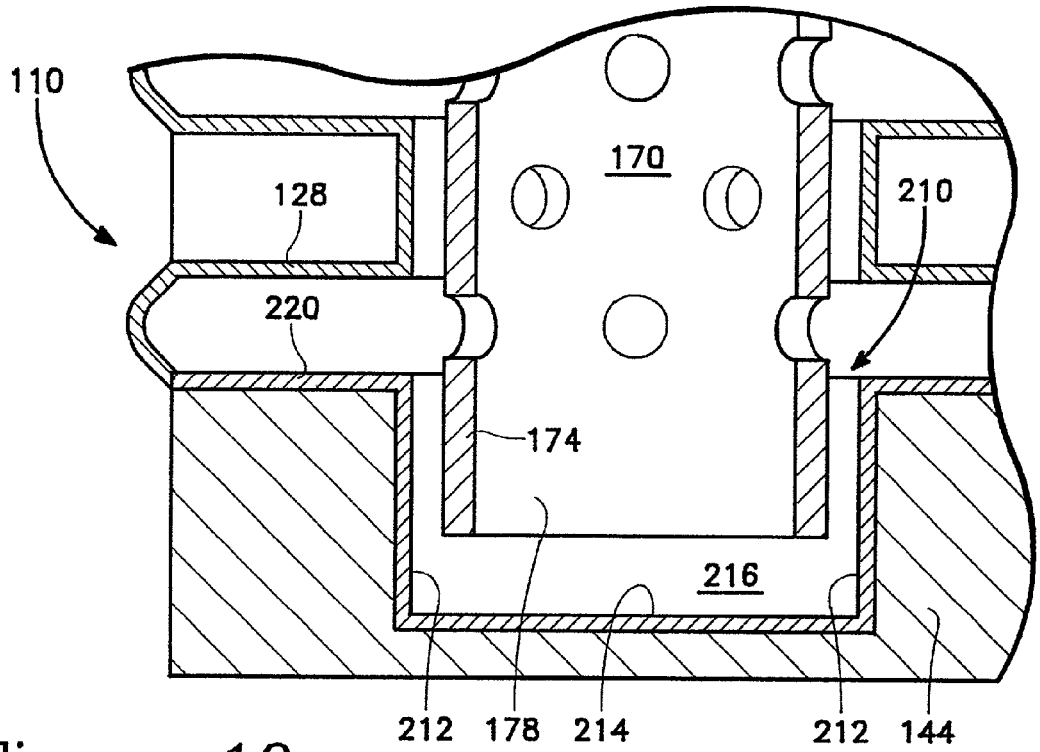
FIGS. 10*a–d* are side cut-away views of a portion of a heat exchanger in accordance with the present invention.

Another embodiment of the present invention includes the use of a lower mount 210 on either or both of the manifold tubes 170 and 180. As shown in FIG. 10*a*, the lower mount 210 is positioned about the bottom end of the inlet manifold tube 170 (shown in this embodiment as an open bottom end 178). The lower mount 210 functions to constrain the tube 170 from being displaced laterally in any significant amount, while at the same time allowing sufficient axial or longitudinal movement. In this manner, the bottom end 178 of the inlet manifold tube 170 can be kept from contacting the ends of the plates 128 and causing damage thereto. The bottom end 178 can move in an axial direction, relative to the second end plate 144. This allows differential thermal expansion to occur between the manifold tube 170 and the core 110 while at the same time restraining the lateral movements of the tube 170. The mount 210 also functions to carry loads from the tube 170 to the second end plate 144. As such, the tubes 170 and 180 can carry additional loads (e.g. from inertia loading or other external sources), without causing damage to the core 110. The specific size and position of the mount 210 can vary depending of the requirements of the specific use in which it is employed. For example, the depth of the mount 210 can vary depending the amount of differential thermal expansion experienced with the particular use.

As can be seen, many alternatives of the configuration of the mount 210 exist. For example, in FIG. 10*a*, the mount 210 includes sides 212, a bottom 214 and an expansion space 216. With the sides 212 being positioned close to the wall 174 of the tube 170, lateral movement of the tube 170 is restrained. The sides 212 extend past the tube end 178 and with the bottom 214, define the expansion space 216. The expansion space 216 allows differential expansion between the tube 170 and the second end plate 144. Preferably the mount 210 also includes an intermediate plate 220 which formed along the second end plate 144 and under the bottom end 178 of the tube 170 (as well as under the tube 180, not shown). The plate 220 functions to prevent air leaking out of the core 110 or from exhaust gas entering the core. The plate 220 is continuous without openings so to provide a seal to prevent passage of air or exhaust gas.

Figure 10B:
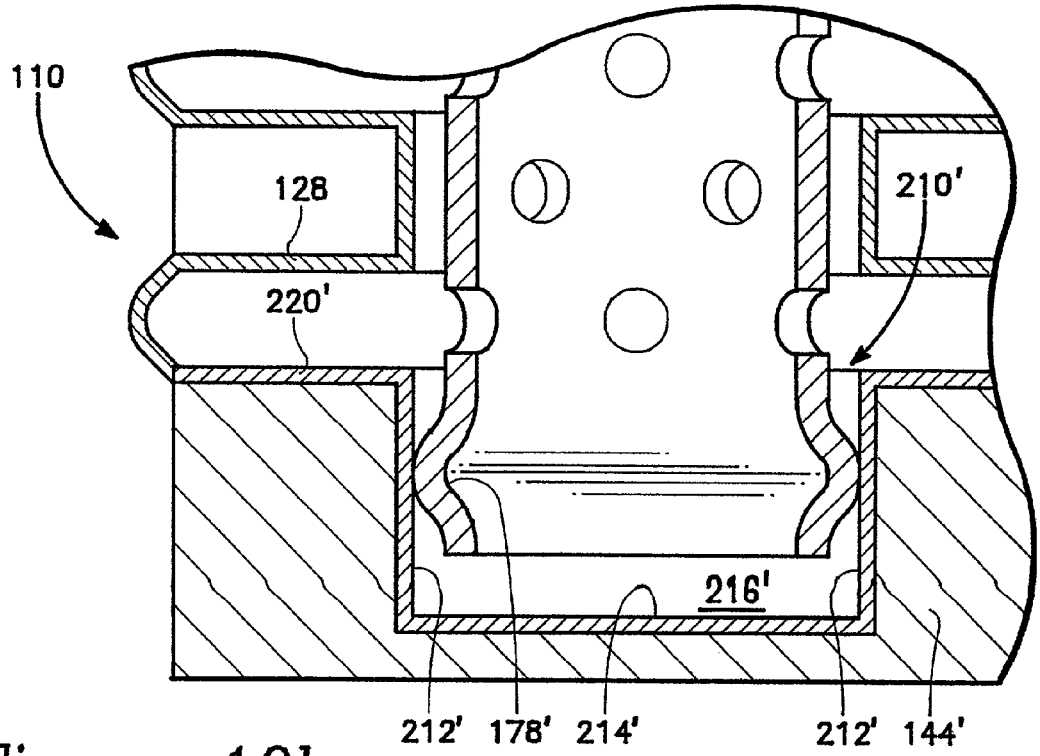

Another embodiment is the lower mount 210', as shown in FIG. 10*b*. In this embodiment the mount 210' includes sides 212', a bottom 214', an expansion space 216' and a flared end 178' on the tube. Like with the other embodiments, the mount 210' functions to limit lateral movement of the tube with the sides 212' and allow axial movement into the expansion space 216', but by employing the flared end 178' has less space between the end 178' and the sides 212' for lateral movement. In the event that there is contact between the end 178' and the sides 212', the flared shape of the end 178' acts to limit the amount of surface contact between the two. The mount 210' also preferably includes an intermediate plate 220' as a seal to prevent air from leaking out of the core 110 or exhaust gas from leaking in.

Figure 10C:
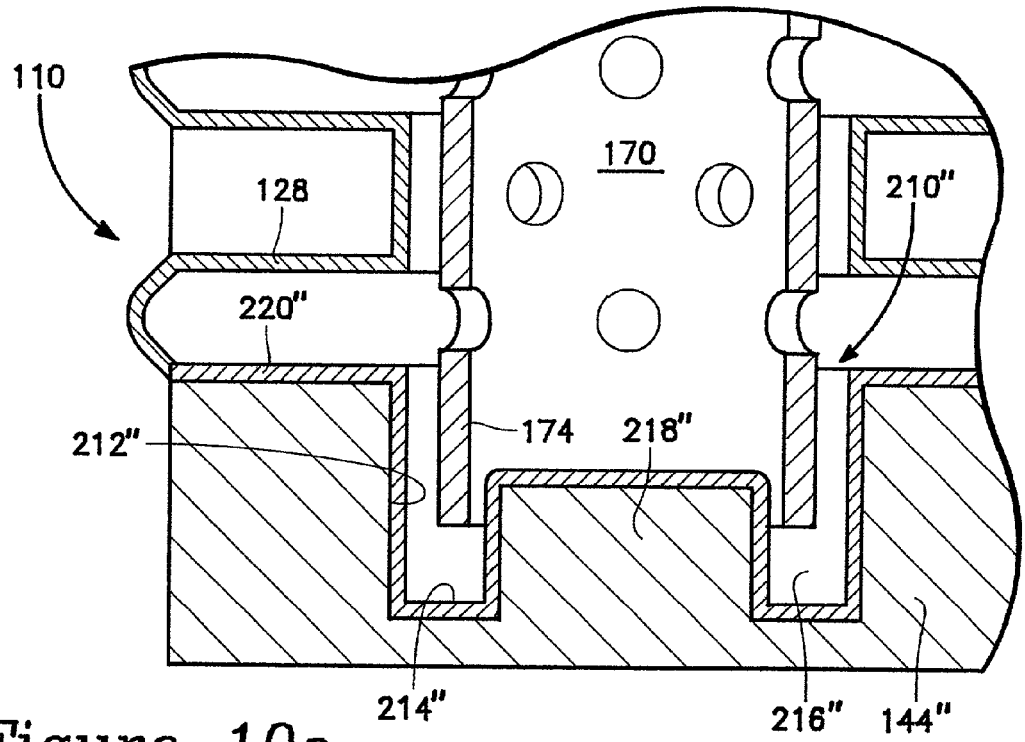

FIG. 10*c* shows another embodiment of the lower mount. The mount 210" includes sides 212", a bottom 214", an expansion space 216" and a limiter 218". In this embodiment, by being positioned along and close to the interior of the tube walls 174, the limiter 218" functions to prevent lateral movement of the tube 170. In this manner the limiter 218" also can carry lateral loads from the tube 170. By extending past the end of the tube 170, the limiter 218" also allows for axial expansion of the tube 170. This allows the tube 170 to differentially expand relative to the core 110. Preferably, the mount 210" includes an intermediate plate 220" which is shaped to fit over the limiter 218" of the second end plate 144" to provide a seal against the passage of air and/or exhaust gas.

Figure 10D:
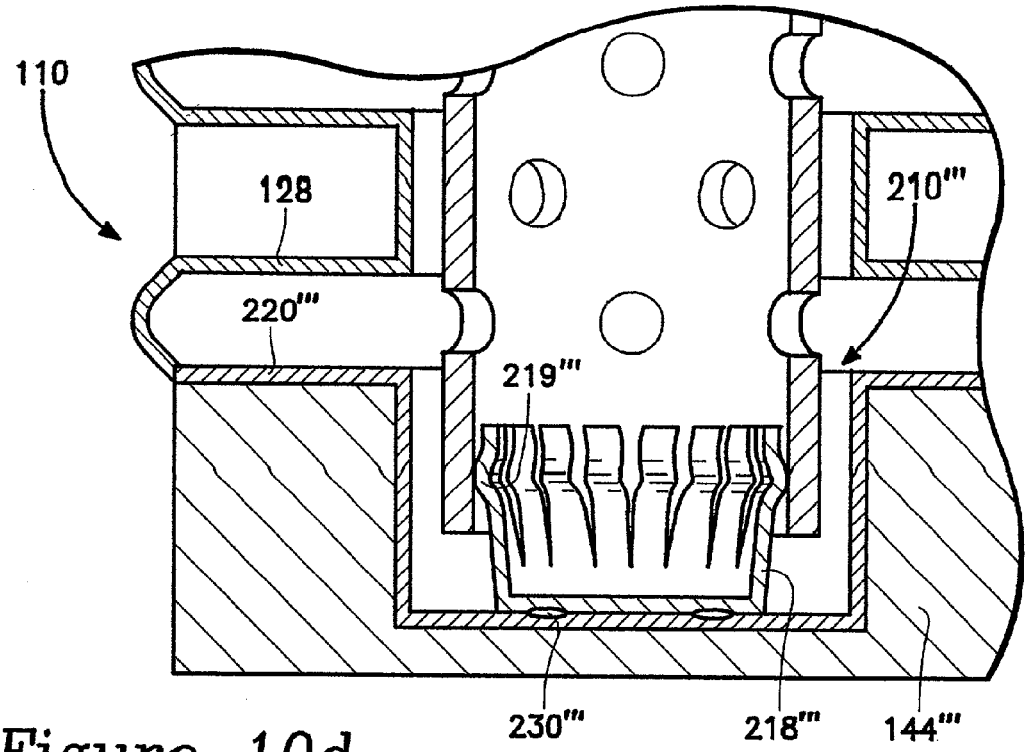

In still another embodiment of the mount, as shown in FIG. 10*d*, the mount 210''' includes a limiter 218''' which is shaped to include a flared portion 219'''. The flared portion 219''' functions to provide a closer positioning between the limiter 218''' and the interior of the tube wall 174, while at the same time minimizing the amount of any contact with the wall 174. As such, the flared portion 219''' minimizes the any resistance to axial expansion of the tube 170. The mount 210''' also preferably includes an intermediate plate 220''' which is shaped to fit over the second end plate 144" and under the limiter 218''', to provide a seal against the passage of air and/or exhaust gas. Also, it is preferred that the limiter 218''' is mounted to the plate 220''' by welds 230''', as shown in FIG. 10*d*.

Although not specifically shown in FIGS. 10*a–d*, the outlet manifold tube 180 can also employ the embodiments of the lower mounts set forth herein.

While the preferred embodiments of the present invention have been described in detail above, many changes to these embodiments may be made without departing from the true scope and teachings of the present invention. The present invention, therefore, is limited only as claimed below and the equivalents thereof.

What is claimed is:

1. A heat exchanger comprising:

a. a core having a heat exchange portion;

b. a fluid-permeable metal tube including a motion limiter attached thereto and extending radially therefrom in a channel wherein the motion limiter limits upward or downward axial motion of the tube, wherein clearance exists in the channel to allow substantially unrestricted sideways movement of the tube due to thermal expansion of the tube wherein at least a portion of the tube extends into the core and is capable of being in contact with the core to transfer loads between the tube and the core, to provide support to the core and to increase the stiffness of the core, and wherein the tube is positioned at least adjacent to the heat exchange portion of the core;

c. a load bearing member positioned adjacent the core; and d. a first mount positioned between the tube and the load bearing member, so that the load bearing member can receive loads from the tube via the motion limiter.

2. The heat exchanger of claim 1, wherein the first mount is adjustable to allow the tube to expand separately from the load bearing member.

3. The heat exchanger of claim 1, further comprising a manifold for passing a fluid from and to the core.

4. The heat exchanger of claim 1, wherein the heat exchanger further comprises a second mount positioned between the tube and the core, wherein the second mount is capable of transferring loads between the tube and the core.

5. The heat exchanger of claim 2, wherein the first mount comprises:

the channel defined by the load bearing member, wherein the motion limiter is received by the channel such that the movement of the motion limiter is restrained by the channel.

6. The heat exchanger of claim 4, wherein the first mount is capable of substantially restraining axial movement of the tube and wherein the second mount is capable of substantially restraining lateral movement of the tube.

7. The heat exchanger of claim 6, wherein the tube further comprises a length and a core end, wherein the core end is positioned within the core and wherein the first mount is positioned along the length of the tube and the second mount is positioned near the core end of the tube.

8. The heat exchanger of claim 7, wherein the second mount is a sliding mount capable of receiving substantially lateral loads from the tube while allowing the tube to expand along its length.

9. The heat exchanger of claim 8, wherein the second mount comprises a cavity defined within the core, wherein the cavity is positioned about the core end of the tube.

10. The heat exchanger of claim 1, wherein the heat exchange portion comprises a layering of heat exchange members.

11. The heat exchanger of claim 10, wherein the tube is positioned at least adjacent the heat exchange members, so to limit movement of the heat exchange members and to receive loads from the heat exchange members, so to increase the stiffness of the core.

12. The heat exchanger of claim 11, wherein the tube is positioned through at least one of the heat exchange members.

13. The heat exchanger of claim 12, wherein the tube defines a passage therewithin, and wherein the tube is permeable so that the passage is in communication with the heat exchange portion of the core.

14. The heat exchanger of claim 1, wherein the tube has a longitudinal axis and wherein the first mount restrains the tube so to allow the transfer of loads aligned substantially with the longitudinal axis of the tube, from the tube via the motion limiter to the load bearing member.

15. The heat exchanger of claim 14, wherein the first mount restrains the tube so to allow the transfer of torsional loads from the tube via the motion limiter to the load bearing member.

16. A heat exchanger comprising:

a. a core having a heat exchange portion, wherein the heat exchange portion comprises a layering of heat exchange members, and wherein the heat exchange members are capable of being displaced substantially laterally;

b. a fluid-permeable metal tube having a length and including a motion limiter extending radially therefrom in a channel wherein the motion limiter limits upward or downward axial motion of the tube, wherein clearance exists in the channel to allow substantially unrestricted sideways movement of the tube due to thermal expansion of the tube wherein at least a portion of the tube extends adjacent to more than one of the heat exchange members and is capable of being in contact with the heat exchange members to transfer loads between the tube and the heat exchange members, to provide support to the core and to increase the stiffness of the core;

c. a load bearing member positioned adjacent the core; and d. a first mount positioned between the tube and the load bearing member, so that the load bearing member can receive loads from the tube via the motion limiter.

17. The heat exchanger of claim 16, wherein the first mount comprises:

the channel defined by the load bearing member, wherein the motion limiter is received by the channel such that the movement of the motion limiter is restrained by the channel.

18. The heat exchanger of claim 16, wherein the heat exchanger further comprises a second mount positioned between the tube and the core, wherein the second mount is capable of transferring loads between the tube and the core.

19. The heat exchanger of claim 18, wherein the second mount is a sliding mount capable of receiving substantially lateral loads from the tube while allowing the tube to expand along its length.

20. A heat exchanger comprising:

a. a core having a heat exchange portion;

b. a fluid-permeable metal tube having a length and an end and including a motion limiter extending radially therefrom in a channel wherein the motion limiter limits upward or downward axial motion of the tube, wherein clearance exists in the channel to allow substantially unrestricted sideways movement of the tube due to thermal expansion of the tube wherein at least a portion of the tube extends into the core so that the end of the tube is positioned within the core, wherein the tube is capable of being in contact with the core to transfer loads between the tube and the core, to provide support to the core and to increase the stiffness of the core, and wherein the tube is positioned at least adjacent to the heat exchange portion of the core;

c. a load bearing member positioned adjacent the core; and d. a mount positioned between the end of the tube and the core, wherein the mount is capable of transferring loads between the tube and the core.

21. A heat exchanger comprising:

a. a core having a heat exchange portion;

b. a tube including a motion limiter attached thereto and extending radially therefrom in a channel wherein the motion limiter limits upward or downward axial motion of the tube, wherein clearance exists in the channel to allow substantially unrestricted sideways movement of the tube due to thermal expansion of the tube wherein at least a portion of the tube extends into the core and is capable of being in contact with the core to transfer loads between the tube and the core, to provide support to the core and to increase the stiffness of the core, and wherein the tube is positioned at least adjacent to the heat exchange portion of the core;

c. a load bearing member positioned adjacent the core;

d. a first mount positioned between the tube and the load bearing member, so that the load bearing member can receive loads from the tube via the motion limiter; and e. a second mount positioned between the tube and the core, wherein the second mount is capable of transferring loads between the tube and the core;

wherein the tube further comprises a length and a core end, wherein the core end is positioned within the core, wherein the first mount is positioned along the length of the tube and the second mount is positioned near the core end of the tube and wherein the first mount is capable of substantially restraining axial movement of the tube and wherein the second mount is capable of substantially restraining lateral movement of the tube.

22. The heat exchanger of claim 21, wherein the second mount is a sliding mount capable of receiving substantially lateral loads from the tube while allowing the tube to expand along its length.

23. The heat exchanger of claim 22, wherein the second mount comprises a cavity defined within the core, wherein the cavity is positioned about the core end of the tube.

* * * * *